US009482444B1

(12) United States Patent
Ramos et al.

(10) Patent No.: US 9,482,444 B1
(45) Date of Patent: Nov. 1, 2016

(54) FABRIC SILENCERS FOR AIR DUCTS

(71) Applicants: Jake Ramos, Dubuque, IA (US); James Partain, Springtown, TX (US); Kevin J. Gebke, Dubuque, IA (US); Michael A. Jacobson, Dubuque, IA (US); Nicholas L. Kaufmann, Sherrill, IA (US); William A. Niehaus, Holy Cross, IA (US)

(72) Inventors: Jake Ramos, Dubuque, IA (US); James Partain, Springtown, TX (US); Kevin J. Gebke, Dubuque, IA (US); Michael A. Jacobson, Dubuque, IA (US); Nicholas L. Kaufmann, Sherrill, IA (US); William A. Niehaus, Holy Cross, IA (US)

(73) Assignee: RITE-HITE HOLDING CORPORATION, Milwaukee, WI (US)

( * ) Notice: Subject to any disclaimer, the term of this patent is extended or adjusted under 35 U.S.C. 154(b) by 0 days.

(21) Appl. No.: 14/717,400

(22) Filed: May 20, 2015

(51) Int. Cl.
*F24F 13/24* (2006.01)

(52) U.S. Cl.
CPC ..... *F24F 13/24* (2013.01)

(58) Field of Classification Search
CPC ..... F24F 13/24
USPC ..... 181/224
See application file for complete search history.

(56) References Cited

U.S. PATENT DOCUMENTS 6,158,082 A * 12/2000 Beckey et al. ..... 15/326
6,715,580 B1 * 4/2004 Gerstner et al. ..... 181/224
6,802,690 B2 * 10/2004 Han et al. ..... 415/119
7,546,899 B2 * 6/2009 Tomerlin et al. ..... 181/252
8,146,706 B2 * 4/2012 Katoh et al. ..... 181/224
2002/0084138 A1 * 7/2002 Weinstein ..... 181/268
2005/0079309 A1 4/2005 Okairi et al.
2006/0272886 A1 * 12/2006 Mueller ..... 181/224
2010/0077755 A1 * 4/2010 Jangili et al. ..... 60/725
2011/0088966 A1 * 4/2011 Geyer, III ..... 181/224
2011/0168482 A1 * 7/2011 Merchant et al. ..... 181/213

FOREIGN PATENT DOCUMENTS

EP 1870629 12/2007

OTHER PUBLICATIONS

Fantech, "LD16,Silencer,16 DIA Duct", Jun. 4, 2015, 1 page.
Dynasonics, "Dynasonics Engineered for Silence", brochure, 8 pages.
International Searching Authority, "Invitation to pay additional fees," issued in connection with PCT application PCT/US2016/033064, mailed Aug. 9, 2016, 6 pages.

* cited by examiner

*Primary Examiner* — Forrest M Phillips
(74) *Attorney, Agent, or Firm* — Hanley, Flight & Zimmerman, LLC

(57) ABSTRACT

Fabric silencers for air ducts are disclosed. An example air duct silencer system includes an inner tube being of a first pliable material, the inner tube defining an airway extending along the inner tube. The example air duct silencer system further includes an outer tube being of a second pliable material, the outer tube to encircle the inner tube to define an annular space between the outer tube and the inner tube. The example air duct silencer system also includes a sound absorbing material to be disposed within the annular space.

29 Claims, 5 Drawing Sheets

FABRIC SILENCERS FOR AIR DUCTS

FIELD OF THE DISCLOSURE

This patent generally pertains to air ducts used in the field of HVAC (heating, ventilating and air conditioning) and, more specifically, to fabric silencers for air ducts.

BACKGROUND

Ductwork is often used to convey conditioned air (e.g., heated, cooled, filtered, humidified, dehumidified, etc.) discharged or drawn from a blower and to distribute the air to a room or other areas within a building. Ducts are typically formed of sheet metal, such as steel, aluminum, or stainless steel. In some installations, a muffler or duct silencer is added to reduce noise often associated with sheet metal ducts. Other air ducts, however, are made of pliable materials, such as fabric or flexible plastic sheeting. Examples of pliable ducts are disclosed in U.S. Pat. No. 6,425,417, which is incorporated herein by reference in its entirety.

DETAILED DESCRIPTION

Example air duct silencer systems for sheet metal and fabric air ducts are disclosed herein. Some such example air duct silencer systems include tubular mufflers made of pliable material rather than sheet metal. In some examples, the muffler includes concentric inner and outer pliable tubes with sound absorbing material contained within an annular gap between the tubes. In some such examples, the inner tube is in intimate, sound-deadening contact with a current of air flowing through the muffler. The outer tube is in intimate, sound-dissipating contact with ambient air surrounding the muffler. In some examples, baffles of a pliable material are in a configuration that prohibits a straight line-of-sight through the muffler. In some examples, a framework inside the muffler holds the inner and/or outer tube taut to provide the muffler with an inflated appearance. In some examples, the framework is spaced apart from upstream and downstream air ducts adjoining the muffler. In some such examples, the independently suspended framework provides the muffler with a sound-deadening mass.

Figure 1:
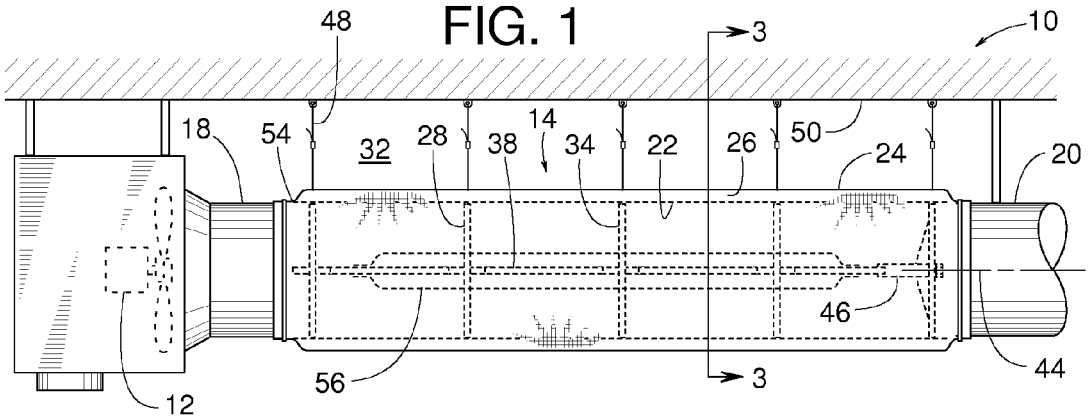
FIG. 1 is a side view of an example air duct silencer system constructed in accordance with the teachings disclosed herein.
Figure 2:
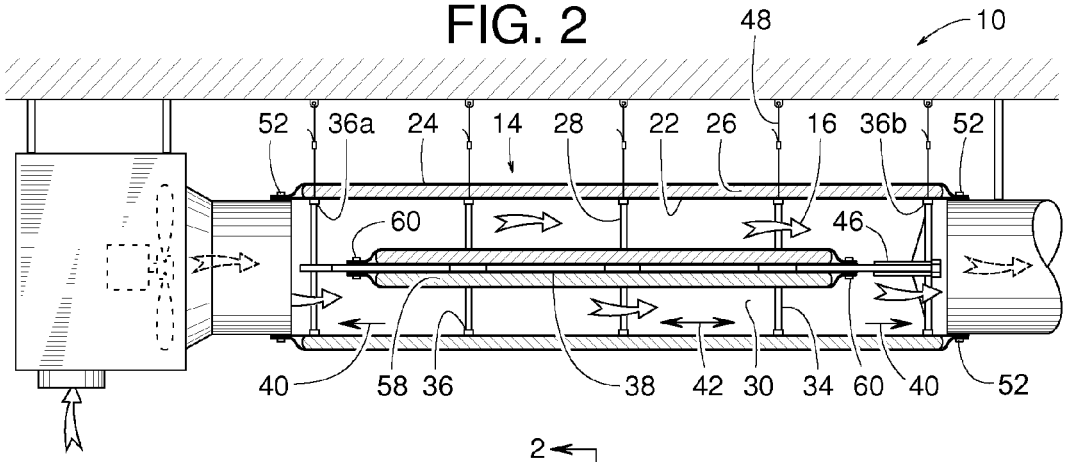
FIG. 2 is a cross-sectional view taken along line 2-2 of FIG. 3.
Figure 3:
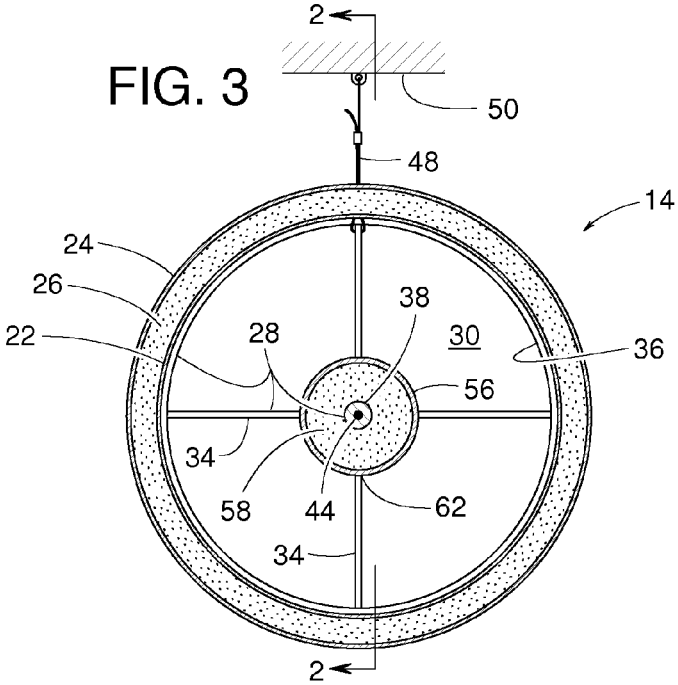
FIG. 3 is a cross-sectional view taken along line 3-3 of FIG. 1.

FIGS. 1-3 show an example air duct silencer system 10 for absorbing and/or attenuating noise from rushing air or HVAC equipment (e.g., a blower 12, a compressor, etc.). In this example, the system 10 includes a tubular muffler 14 comprising a special arrangement of fabric and sound absorbing material. The muffler 14 absorbs noise as the muffler conveys a current of air 16 between conventional upstream and downstream air ducts 18, 20. The conventional air ducts 18, 20 can be made of any known material, examples of which include, but are not limited to, sheet metal, fabric, pliable polymeric sheeting, and various combinations thereof. In some examples, the pliable material use to form the tubes 22, 24 is air permeable in a radial direction.

In the example illustrated in FIGS. 1-3, the muffler 14 comprises an inner tube 22 of a pliable material, a concentric outer tube 24 of a pliable material surrounding the inner tube 22, a sound absorbing material 26 in the annular space between tubes 22, 24, and an internal frame 28 installed within inner tube 22 and/or outer tube 24. Examples of the sound absorbing material 26 include, but are not limited to, rock wool, fiberglass insulation, felt, foam, and materials formed by spinning or drawing of molten materials. In some examples, to absorb, attenuate, and/or dissipate noise, at least ninety percent of the pliable interior surface of the inner tube 22 is in intimate (i.e., direct), unobstructed contact with an open airway 30 of the inner tube 22, and at least ninety percent of the pliable exterior surface of outer tube 24 is in intimate (i.e., direct), unobstructed contact with the surrounding ambient air 32.

The term, "pliable" refers to a material that can be readily folded over onto itself and later unfolded and restored to its original shape without appreciable damage to the material. Fabric is one example of a pliable material, and sheet metal is an example of a material that is not pliable. Examples of pliable materials for the tubes 22, 24 include, but are not limited to, polymer coated or impregnated cloth fabric, uncoated fabric, polyester, vinyl, other polymeric or non-metallic sheet materials, natural rubber, synthetic rubber, chlorosulfonated polyethylene, mass-loaded vinyl, and various combinations thereof. In some examples, the sound absorbing material is less dense than the pliable material used to form the tubes 22, 24. In some examples, the sound absorbing material is more porous than the pliable material used to form the tubes 22, 24.

The frame 28 is schematically illustrated to represent any structure being primarily made of metal or made of another material having sufficient strength and rigidity to hold the tube 22 in longitudinal tension and radial expansion. In some examples, the frame 28 is omitted when the sound absorbing material 26 is sufficiently rigid to hold the tubes 22, 24 taut lengthwise and/or radially expanded to provide the tubes 22, 24 with a permanently inflated appearance. In some examples, however, the frame 28 comprises a plurality of radial spokes 34 that connect a plurality of hoops 36 to a longitudinally extendible central shaft 38. In some examples, the two end hoops 36*a*, 36*b* are affixed axially to both the shaft 38 and the inner surface of the inner tube 22 so that lengthening the shaft 38 exerts a tensile force 40 that pulls inner tube 22 taut. The tensile force 40 places the inner tube 22 in tension in a direction 42 substantially parallel to a longitudinal centerline 44 of the inner tube 22. To lengthen the shaft 38, some examples of the shaft 38 have a telescopically adjustable threaded section 46. In some examples, the muffler 14 is suspended from a series of hangers 48 that have a lower end connected to the frame 28, the inner tube 22, and/or the outer tube 24, and have an upper end connected to an overhead support structure 50 (e.g., beam, ceiling, cable, etc.). Examples of the hangers 48, the adjustable section 46, the frame 28, and other means for supporting pliable air ducts or expanding shafts are disclosed in U.S. Pat. No. 8,434,526 and in U.S. Published Patent Application No. 2014/0261835; both of which are incorporated herein by reference in their entireties.

In some examples, a fastening means 52 closes the axial ends of tubes 22, 24 to each other and/or to the axial ends of the adjacent inlet and outlet air ducts 18, 20. The inlet air duct 18 and/or the outlet air duct 20 can be made of sheet metal or made of a pliable material. Examples of the fastening means 52 include, but are not limited to, a zipper, a sewn seam, a hook-and-loop fastener, clips, snaps, hooks, a drawstring, and a circumferentially constricting band or strap.

In examples where the inlet air duct 18 is made of sheet metal, the frame 28 is spaced apart from the sheet metal to prevent noise carried by the duct 18 from readily transferring to the frame 28. Likewise, in examples where the outlet air duct 20 is made of sheet metal, the frame 28 is spaced apart from that sheet metal as well to prevent vibration within the frame 28 from propagating directly to the outlet air duct 20. The term "air duct" refers to any hollow structure for conveying a current of air. To maintain the spaced-apart relationship between the frame 28 and the adjacent air ducts 18, 20, in some examples, an extension of pliable material 54 from the inner tube 22 and/or the outer tube 24 spans the gap between the frame 28 and the adjacent metal air ducts 18, 20. With such an arrangement, the frame 28 effectively serves as an independently suspended sound-deadening mass acting between the inlet air duct 18 and the outlet air duct 20.

To further reduce noise, some example mufflers include a central tube 56 of a pliable material encasing a sound absorbing material 58 encircling the shaft 38. In some examples, the central tube's pliable material is chosen from the same set of example materials used for the tubes 22, 24. In some examples, the sound absorbing material 58 is chosen from the same set of examples used for the sound absorbing material 26. In some examples, a fastening means 60 closes the axial end of the tube 56 to the shaft 38. Examples of the fastening means 60 include, but are not limited to, a hook-and-loop fastener, clips, snaps, hooks, a drawstring, a hose clamp, and a circumferentially constricting band or strap. In some examples, the spokes 34 between the hoops 36 and the shaft 38 extend through radial openings 62 in the central tube 56.

Figure 4:
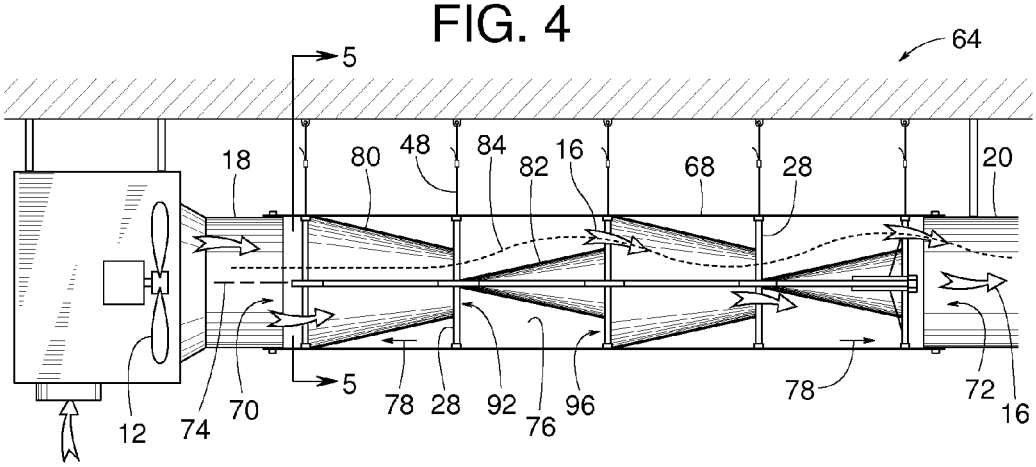
FIG. 4 is a cross-sectional view taken along line 4-4 of FIG. 5 showing another example air duct silencer system constructed in accordance with the teachings disclosed herein.
Figure 5:
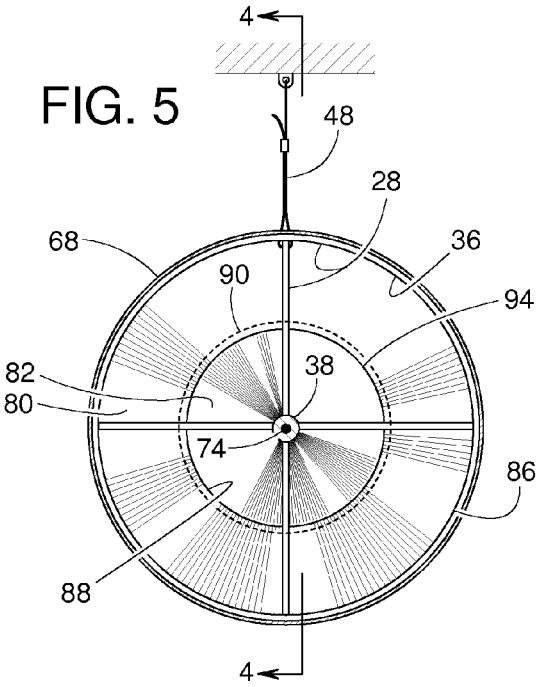
FIG. 5 is a cross-sectional view taken along line 5-5 of FIG. 4.
Figure 6:
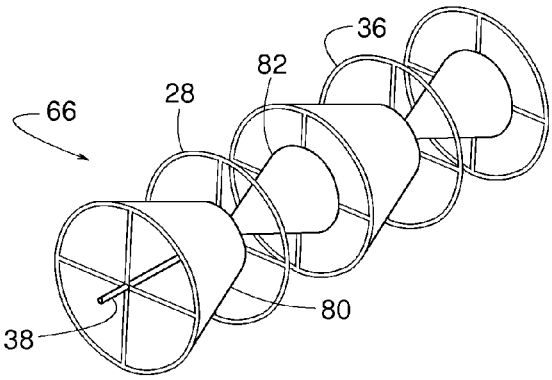
FIG. 6 is a perspective view of an example muffler used in the example air duct silencer system shown in FIGS. 4 and 5.

In addition or alternatively, some example air duct silencer systems include a baffle system that blocks and/or attenuates noise while allowing air to pass. FIGS. 4-6, for instance, show an example air duct silencer system 64 comprising the frame 28, the hangers 48, a baffle system 66, and a first tube 68 of a structure basically identical to the inner tube 22. The outer tube 24 with the sound absorbing material 26 surrounding the tube 68 is an optional implementation of the system 64. In the illustrated example, the tube 68 defines an inlet 70, an outlet 72 and a longitudinal centerline 74 extending from the inlet 70 to the outlet 72. The tube 68 of the illustrated example also defines an open airway 76 extending from the inlet 70 to the outlet 72. As with the example muffler 14 of FIGS. 1-3, the frame 28 is attached to the tube 68 and exerts a tensile force 78 that subjects the tube 68 to tension in a direction substantially parallel to the centerline 74.

In the illustrated example, the baffle system 66 includes a first baffle 80 and a second baffle 82 attached to the frame 28 and disposed within the open airway 76. In some examples, both of the baffles 80, 82 are generally conical and made of a pliable sheet of material. In some examples, the pliable material of the baffles 80, 82 is chosen from the same set of example materials used for the tubes 22, 24 of the muffler 14. As shown in the illustrated example, the baffle system 66 in conjunction with the tube 68 defines a flow path 84 through the open airway 76. To prevent sound from readily passing straight through the tube 68, the flow path 84 is sufficiently tortuous to preclude a straight line-of-sight from the inlet 70 to the outlet 72. In some examples, to achieve the non-linear flow path 84, the first baffle 80 extends radially between an outer diameter 86 at the tube 68 and an inner diameter 88 at a ring 90 attached to the frame 28. The first baffle 80 defines a central opening 92 between the ring 90 and the shaft 38. The second baffle 82, which is smaller than the first baffle 80 in some examples, extends radially between the shaft 38 and an outer diameter 94 equal to or slightly larger than the first baffle's inner diameter 88. In some examples, the baffles 80, 82 overlap radially between diameters 88 and 94. That is, in some examples, the ring 90 is further away from the inlet 70 than the beginning of the second baffle 82. In other examples, the second baffle 82 may begin further away from the inlet 70 than the ring 90 defining the central opening associated with the first baffle 80. In other examples, the first baffle 80 ends approximately at the same point as the second baffle 82 begins when moving along the length of the tube 68.

As shown in FIG. 4, in some examples, the tube 68 includes the first and second baffles 80, 82 arranged in an alternating repeated series. Thus, in some examples, the second baffle 82 is followed by another baffle similar or identical to the first baffle 80, which may be followed by another baffle similar or identical to the second baffle 82. In some examples, additional baffles 80, 82 may be arranged in series within the tube 68. In some examples, the second baffle ends at approximately the same point along the tube 68 as the next baffle (e.g., another first baffle 80) begins. In other examples, the second baffle 82 may end somewhat before and/or somewhat after the next baffle begins. As a result of the alternating arrangement of the baffles 80, 82, the air 16 flowing along the path 84 runs alternately through the central opening 92 and an annular gap 96 between tube 68 and the second baffle's outer diameter 94. In some examples, the conical shape of the baffles 80, 82 point in opposite longitudinal directions to minimize flow resistance through the airway 76.

Figure 7:
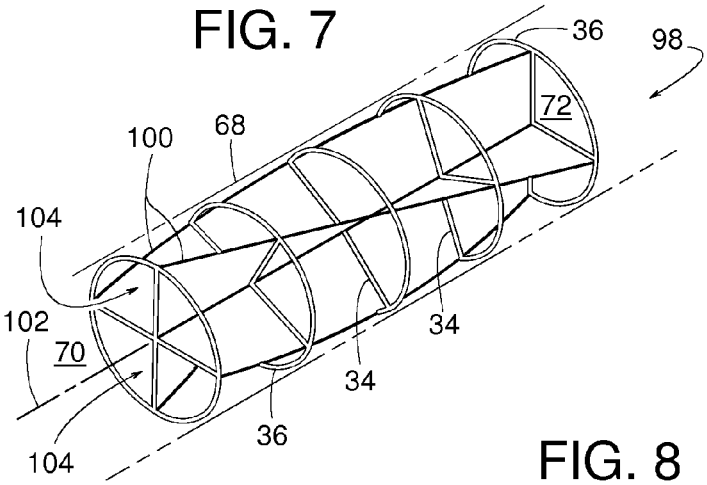
FIG. 7 is a perspective view similar to FIG. 6 but showing another example muffler constructed in accordance with the teachings disclosed herein.

FIG. 7 shows another example baffle system 98 that, when installed within the tube 68, blocks noise while allowing the air 16 to pass. In this example, the system 98 includes a plurality of baffles 100 arranged substantially helically around a longitudinal centerline 102. In some examples, the generally helical shape creates one or more helical airways 104 that are fully open from one longitudinal end of the tube 68 to the other. However, in some such examples, the helical baffles 100 preclude a straight line-of-sight from the inlet 70 to the outlet 72 when installed in the tube 68. In some examples, the hoops 36 are rotationally offset to each other so that their respective spokes 34 hold the baffles 100 in their helical shape.

Figure 8:
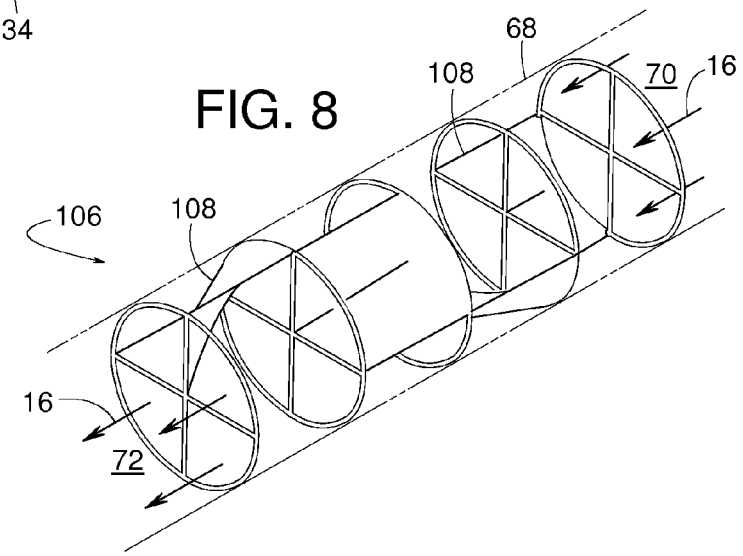
FIG. 8 is a perspective view similar to FIGS. 6 and 7 but showing another example muffler constructed in accordance with the teachings disclosed herein.

FIG. 8 shows another example baffle system 106 that, when installed within the tube 68, blocks noise while allowing the air 16 to pass. In this example, the system 106 includes a plurality of baffles 108 with each baffle 108 obstructing a different quadrant or other pie section or segment (greater or less than a quadrant) of each hoop 36 until every quadrant or other pie section is covered, thereby precluding a straight line-of-sight from the inlet 70 to the outlet 72. In some examples, the remaining three quadrants or other pie sections are open for the air 16 to pass. In some examples, the baffle systems 98, 108 shown in FIGS. 7 and 8 are implemented with the hoops 36 spaced apart and held in place along the tube 68 via releasable tabs, loops, or other fasteners without a central shaft extending between adjacent ones of the hoops. In some other examples, the baffle systems 98, 108 may be implemented with the hoops 36 interconnected via a central shaft the same as or similar to the shaft 38 shown in FIGS. 4-6.

Figure 9:
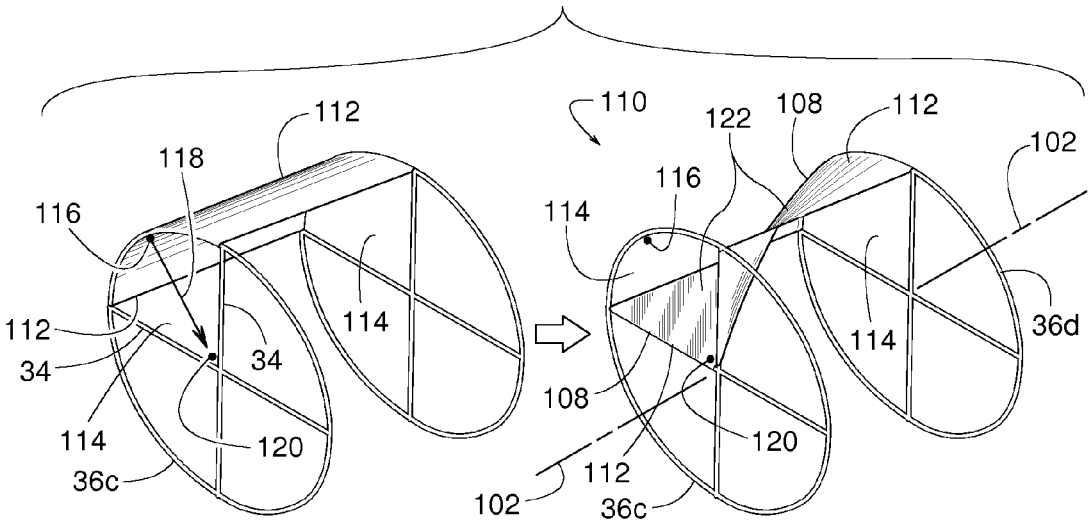
FIG. 9 is a schematic diagram showing a method of creating an example baffle assembly used in the example muffler shown in FIG. 8.

In some examples, the baffles 108 have a shape as shown in FIG. 8 and the right side of FIG. 9. In other examples, the baffles 108 have a shape that deviates from the illustrated shape. For instance, in some examples, the baffle 108 has a pie shape that lies flat and perpendicular to centerline 102 (e.g., in the plane of one of the hoops 36). To help in visualizing the shape of baffle 108 of the illustrated example, FIG. 9 shows a progression of how a baffle assembly 110 with baffle 108 can be created. Procedures other than the illustrated progression may alternatively be used to arrive at the structure shown in the drawings. The left image in FIG. 9 shows a pliable sheet material 112 wrapped ninety degrees around the outer diameter of one quadrant 114 of hoops 36*c* and 36*d*. From an outer peripheral point 116 circumferentially midway between the two spokes 34 of the hoop 36*c*, the sheet material 112 is pulled radially inward 118 and anchored to a central point 120 near centerline 102, as shown in the right image of FIG. 9. The resulting distorted sheet material 112 creates a baffle 108 that covers the quadrant 114. Each baffle 108, in the illustrated example, extends from an arced portion of a first hoop (e.g., the hoop 36*d*) to two spokes 34 of an adjacent hoop (e.g., the hoop 36*c*) where the arced portion and two spokes correspond to the quadrant or other pie section to be closed off from direct air flow. Pie segments of different sizes may alternatively be closed off by connecting the baffles 108 to spokes that are at different angles greater or less than ninety degrees.

In some examples, the sheet material 112 extending between the hoops 36*c*, 36*d* transitions from being cylindrical at hoop 36*d* to a right angle at hoop 36*c*, thereby creating a non-developable surface 122. The term, "non-developable surface" refers to shapes having a compound curvature that renders the shape impossible to flatten onto a plane without shrinking or stretching the material. For example, a flat sheet of paper can be formed into the shape of a cone or a cylinder without having to stretch or wrinkle the sheet, thus cones and cylinders are not considered as having a non-developable surface. A flat sheet of paper, however, cannot be formed into a sphere without stretching or wrinkling the sheet, thus a sphere is considered to have a non-developable surface.

Figure 10:
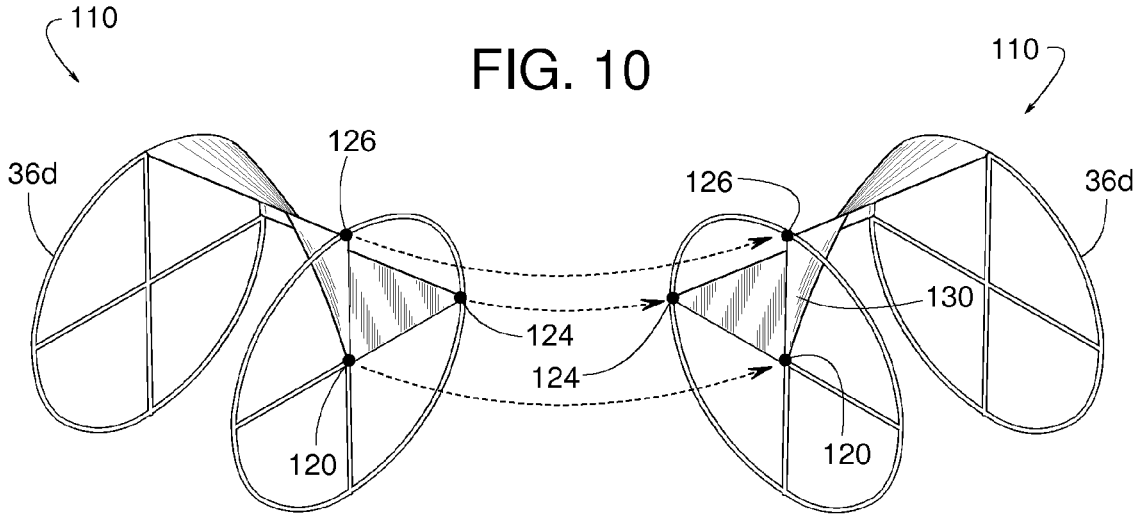
FIG. 10 is a schematic diagram showing a method of creating an example dual-baffle assembly using the example baffle assembly shown in FIG. 9.
Figure 11:
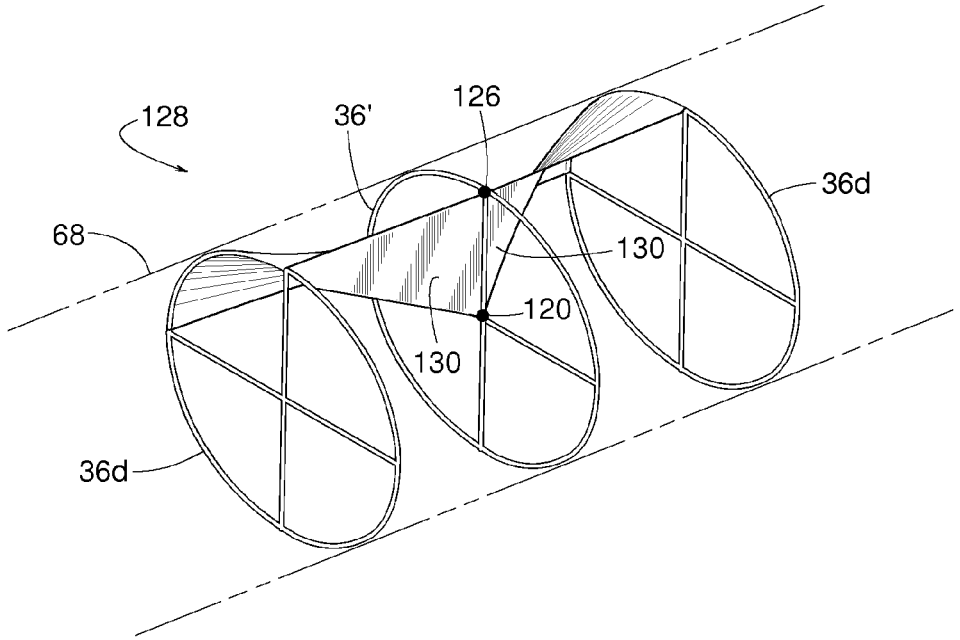
FIG. 11 is a perspective view showing the example dual-baffle assembly referenced in FIG. 10.

In some examples, as shown in FIG. 8, the baffles 108 are oriented such that the end of the baffle attached to the arced portion of the hoop 36*d* is upstream (closer to the inlet 70) of the end of the baffle attached to the two spokes 34. Additionally or alternatively, in some examples, two baffle assemblies 110 are mounted facing each other (each baffle oriented in the opposite direction with the same pie segment to be closed off and aligned with each other), as shown in FIGS. 10 and 11. More specifically, as shown in the illustrated example, points 120, 124, 126 of one baffle assembly 110 are connected respectively to corresponding points 120, 124, 126 of the other baffle assembly 110. In some examples, instead of two hoops 36*c* (from each of the two assemblies 110), only one hoop 36' is employed where the three pairs of points 120, 124, 126 come together. This creates a dual-baffle assembly 128 having an aerodynamic inclined surface 130 facing both upstream and downstream. In some examples, multiple dual-baffle assemblies 128 are stacked end-to-end with each dual-baffle assembly 128 being rotationally offset to the others so that each dual-baffle assembly obstructs a different quadrant or other pie section until every quadrant or other pie section is covered. In some examples, multiple dual-baffle assemblies are nested to reduce the number of hoops 36 and reduce the muffler's overall length. For example, a first baffle may be attached to an arced portion of a first pie segment of a particular hoop 36 while a second baffle is attached to two spokes 34 of the same hoop 36 but for a second different pie segment of the hoop 36.

Figure 12:
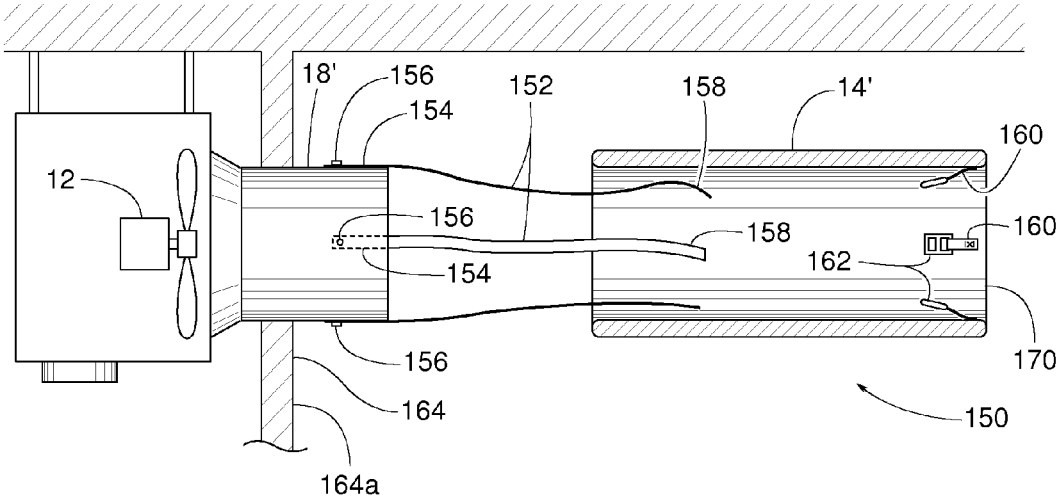
FIG. 12 is an exploded cross-sectional side view of another example air duct silencer system constructed in accordance with the teachings disclosed herein.
Figure 13:
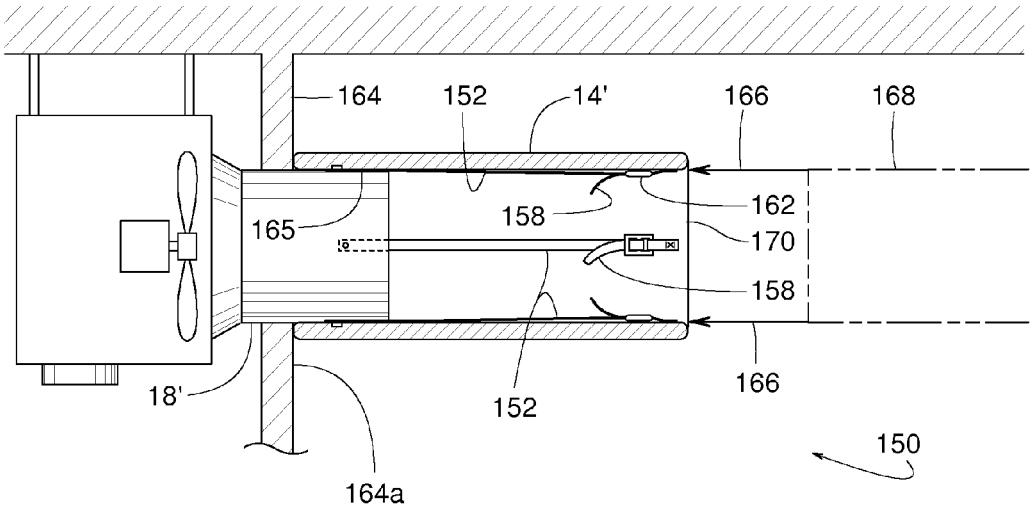
FIG. 13 is a cross-sectional side view of the example air duct silencer system shown in FIG. 12.

FIGS. 12 and 13 show an example air duct silencer system 150 that includes a series of straps 152 for holding an example muffler 14' in place. FIG. 12 shows the muffler 14' about to be installed, and FIG. 13 shows the muffler 14' after installation. In this example, each strap 152 has one end 154 fastened to the exterior of a rigid air duct 18'. The straps 152 can be of any quantity, e.g., one, two, three, four, etc. In some examples, a threaded fastener 156 connects the strap end 154 to the air duct 18'. An opposite end 158 of each strap 152 connects to a point 160 on the interior of the muffler 14'. Connecting the strap end 158 to the point 160 can be accomplished using any suitable connecting means 162. Examples of connecting means 162 include, but are not limited to, a clip, a buckle, a snap, a touch-and-hold fastener, a ratchet, a strap segment sewn to the muffler 14', and combinations thereof.

When the muffler 14' is positioned as shown in illustrated example of FIG. 13, tightening the straps 152 holds the muffler 14' against a backstop 164 (e.g., a wall 164*a*, a fan housing, a flange on the air duct 18', etc.). In some examples, once the straps 152 are fastened and tightened, a portion 165 of each strap 152 lies radially between the air duct 18' and the interior of the muffler 14'. In some examples, the muffler 14' is constructed similarly to the other example mufflers described herein. As indicated by the arrows 166, any suitably sized rigid or pliable air duct 168 can be attached to a downstream end 170 of muffler 14'.

For further clarification, it should be noted that, as used in this patent, the term, "open airway" is defined to mean that air can flow through the airway via a straight or tortuous path. As used in this patent, the term, "tortuous" as it relates to an airway is defined to mean that the airway is not straight (e.g., it is twisted, crooked or winding). As used in this patent, the term, "internal" as it relates to an internal frame and a corresponding tube is defined to mean that at least part of the frame is inside the tube. There are a number of benefits and advantages of one or more systems illustrated in FIGS. 1-13 over the prior art. For example, fabric and pliable plastic materials offer weight savings over alternate sheet metal parts. Fabric and pliable plastic materials absorb noise while sheet metal reflects it. Some example pliable materials have a Noise Reduction Coefficient (NRC) of 0.2 (as tested to ASTM C423-02a). Some example pliable materials are rated for Class-1 (or ISO Class-3) clean room applications. Some of the illustrated example mufflers have a longitudinal seam that allows the pliable tubes to be split open and flattened for more compact shipping and/or storage. Pliable tube mufflers do not required welded joints (as often found in metal mufflers) such that pliable tube mufflers can be disassembled for repairing or cleaning.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

What is claimed is:

1. An air duct silencer system comprising:

an inner tube being of a first pliable sheet material, the inner tube defining an airway extending along the inner tube;

an outer tube being of a second pliable sheet material, the outer tube to encircle the inner tube to define an annular space between the outer tube and the inner tube; and a sound absorbing material to be disposed within the annular space.

2. The air duct silencer system of claim 1, wherein the first pliable material and the second pliable material are identical.

3. The air duct silencer system of claim 1, wherein the sound absorbing material is less dense than the first pliable material and less dense than the second pliable material.

4. The air duct silencer system of claim 1, wherein the sound absorbing material is more porous than the first pliable material and more porous than the second pliable material.

5. The air duct silencer system of claim 1, wherein most of the second pliable material is polymeric.

6. The air duct silencer system of claim 1, further including a blower discharging a current of air through the airway.

7. The air duct silencer system of claim 1, wherein the inner tube is to be coupled to a blower that discharges a current of air through the inner tube, wherein a metal air duct is downstream of the inner tube with respect to the current of air.

8. The air duct silencer system of claim 1, wherein the inner tube includes a tubular wall that is air permeable.

9. The air duct silencer system of claim 1, wherein the sound absorbing material provides structural support to hold the outer tube in a radially expanded shape.

10. The air duct silencer system of claim 1, further including an internal frame to be attached to at least one of the inner tube and the outer tube, the internal frame to exert a tensile force to the at least one of the inner tube and the outer tube, the tensile force placing the at least one of the inner tube and the outer tube in tension along a length of the at least one of the inner tube and the outer tube.

11. The air duct silencer system of claim 10, wherein the internal frame includes a plurality of hoops to radially engage the at least one of the inner tube and the outer tube, the plurality of hoops to hold the at least one of the inner tube and the outer tube in a radially expanded shape.

12. The air duct silencer system of claim 11, further including an overhead support structure above the inner tube and attached to the plurality of hoops.

13. The air duct silencer system of claim 1, further including:

a central tube being of a third pliable material, the central tube to be disposed within the inner tube, the airway to surround the central tube and to be radially interposed between the central tube and the inner tube; and a second sound absorbing material disposed within the central tube.

14. An air duct silencer system comprising:

a first pliable tube defining an airway, the first tube to convey a current of air from a blower between an inlet air duct and an outlet air duct; and an internal frame attached to the first tube, the internal frame to exert a tensile force that subjects the first tube to tension in a direction substantially parallel to a centerline of the first tube, wherein the internal frame includes metal and is spaced apart from both the inlet air duct and the outlet air duct.

15. The air duct silencer system of claim 14, wherein a gap between the frame and at least one of the inlet air duct or the outlet air duct is to be spanned solely by at least one pliable tube.

16. The air duct silencer system of claim 14, further including:

a second pliable tube encircling the first tube to define an annular space between the first tube and the second tube; and a sound absorbing material disposed within the annular space.

17. The air duct silencer system of claim 14, further including:

a central pliable tube within the first pliable tube, the airway surrounding the central tube and radially interposed between the central tube and the first tube; and a sound absorbing material disposed within the central tube.

18. The air duct silencer system of claim 14, wherein the internal frame includes a plurality of hoops radially engaging the first tube, the plurality of hoops holding the first tube in a radially expanded shape.

19. The air duct silencer system of claim 18, further including an overhead support structure attached to the plurality of hoops to support the first tube.

20. The air duct silencer system of claim 14, further including a first baffle to be disposed within the airway, the first baffle including a pliable sheet of material, the baffle defining a flow path within the first tube through the airway from the inlet to the outlet, the flow path being tortuous such that there is not a straight line-of-sight from the inlet to the outlet.

21. The air duct silencer system of claim 20, wherein the pliable sheet has a substantially helical surface.

22. The air duct silencer system of claim 20, wherein the first baffle is substantially conical.

23. The air duct silencer system of claim 22, further including a second baffle that is substantially conical, the first baffle being larger than the second baffle.

24. The air duct silencer system of claim 22, further including a second baffle that is substantially conical, the first baffle and the second baffle pointing in opposite directions.

25. The air duct silencer system of claim 20, wherein the first baffle has a non-developable surface.

26. The air duct system of claim 20, wherein the first baffle has a non-developable surface extending from an inner diameter of the first tube toward the centerline of the first tube.

27. An air duct system, comprising:

a first pliable tube to extend between a rigid inlet air duct and a rigid outlet air duct; and a frame disposed within the first pliable tube and spaced apart from the inlet and outlet air ducts, the frame to support the first pliable tube in a radially expanded shape.

28. The air duct system of claim 27, further including a plurality of baffles to be coupled to the frame to prevent a straight line-of-sight through the first pliable tube between the inlet and outlet air ducts.

29. The air duct system of claim 28, wherein the first pliable tube extends in a substantially straight line between the inlet and outlet air ducts.

* * * * *